United States Patent [19]

Kollmann

[11] Patent Number: 4,834,291

[45] Date of Patent: May 30, 1989

[54] FUEL INJECTOR

[75] Inventor: James D. Kollmann, Mount Calvary, Wis.

[73] Assignee: Brunswick Corporation, Skokie, Ill.

[21] Appl. No.: 122,895

[22] Filed: Nov. 19, 1987

[51] Int. Cl.[4] ..... F23D 14/60

[52] U.S. Cl. ..... 239/408; 239/415; 239/416

[58] Field of Search ..... 239/407–410, 239/415, 416, 417, 416.5, 533.3–533.9, 585.8, 459

[56] References Cited

U.S. PATENT DOCUMENTS

| | | | |
|---|---|---|---|
| 771,769 | 10/1904 | Davies | 239/417.3 X |
| 1,028,973 | 6/1912 | Smith | 239/416.5 |
| 1,393,090 | 10/1921 | Cowardin | 239/408 X |
| 1,431,473 | 10/1922 | Lovejoy | 239/408 X |
| 1,793,154 | 2/1931 | Bellem et al. | 239/410 |
| 1,834,061 | 12/1931 | Joachim | 239/410 |
| 3,785,570 | 1/1974 | Krieger | 239/413 X |

*Primary Examiner*—Andres Kashnikow
*Assistant Examiner*—Kevin Weldon
*Attorney, Agent, or Firm*—Andrus, Sceales, Starke & Sawall

[57] ABSTRACT

A fuel injector for an internal combustion engine includes a body having fuel and air inlet ports and fuel and air outlet ports located within the combustion chamber of the engine cylinder. A pair of valves open and close the air and fuel outlet ports and are sequenced so that fuel is introduced into a flow of air and the flow of air continues briefly after the fuel flow has been discontinued.

11 Claims, 3 Drawing Sheets

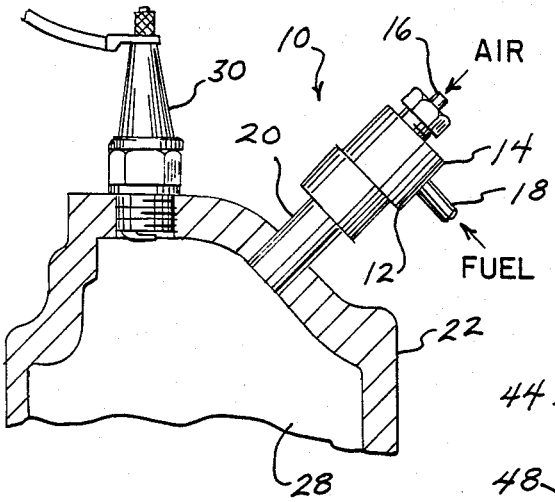
FIG. 1
FIG. 2
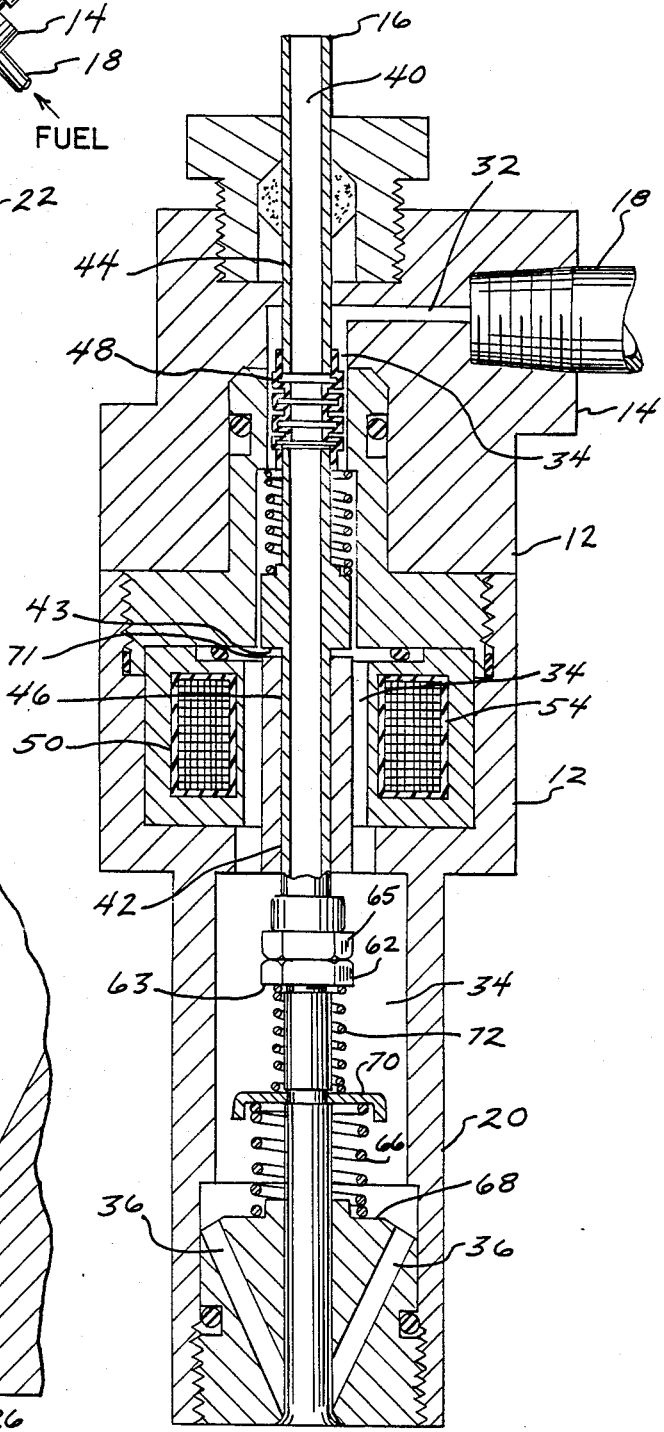
FIG. 7
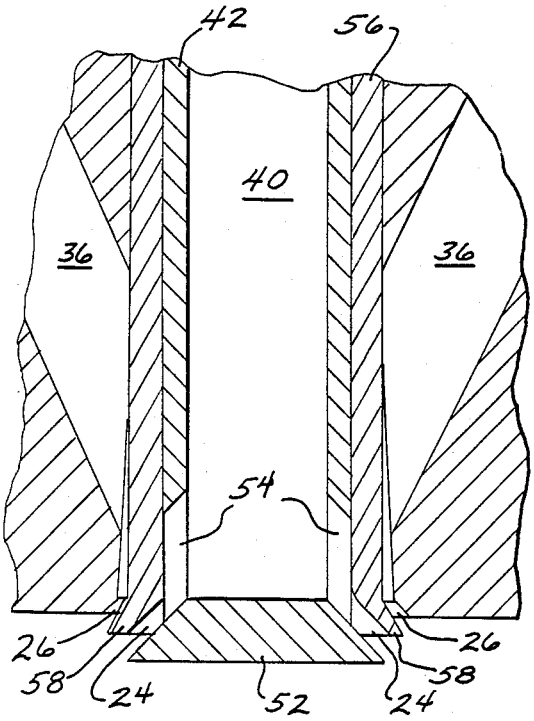

FUEL INJECTOR

BACKGROUND OF THE INVENTION

Internal combustion engines often utilize fuel injection systems rather than the typical carburation system. Such fuel injection systems can utilize an additional air pump to provide pressurized air which is mixed with fuel internally within the fuel injector and the fuel/air mixture is injected into the combustion chamber of the cylinder. It is desirable to provide higher speed of operation of the injector at relatively low pressures while obtaining proper atomization of the fuel.

The present invention provides a fuel injector that operates at low pressure and directly feeds the fuel into an air stream directed into the combustion chamber. The fuel is thus broken up into smaller particles from the beginning to the end of the cycle.

The present invention provides a fuel injector satisfactory for directly injecting fuel into the cylinder of a two-cycle, spark ignition engine operating over the speed range of typical outboard motors.

SUMMARY OF THE INVENTION

A fuel injector for an internal combustion engine includes a body which extends into the combustion chamber of the cylinder and which has an air inlet port and a fuel inlet port leading to a pair of passageways that terminate in an air outlet port and a fuel outlet port located within the combustion chamber.

In accordance with yet another aspect of the invention, the fuel injector is provided with a first valve which moves between an open and closed position in which the air outlet port is alternately open and closed.

In accordance with yet another aspect of the invention, the fuel injector is provided with a second valve which moves between a first and second position in which the fuel outlet port is alternately open and closed.

In accordance with still another aspect of the invention, the fuel injector is provided with an actuator which moves the two valves between their open and closed positions and which controls the sequence such that the air valve is opened prior to the opening of the fuel valve and upon closing the fuel valve is closed prior to the closing of the air valve. This sequencing is provided so that when fuel is introduced into the combustion chamber it is introduced directly into the path of an airflow and the airflow is continued for a short time period after the fuel flow has been discontinued.

In accordance with yet another aspect of the invention, the fuel injector is provided with an adjustment that allows the timing of the operation of the valves to be varied.

The present invention thus provides a fuel injector that directly introduces fuel into an air stream in the combustion chamber and which operates at low pressures.

BRIEF DESCRIPTION OF THE DRAWINGS

The drawings illustrate the best mode presently contemplated of carrying out the invention.

In the drawings:

FIG. 1 is a cross sectional view of a cylinder in an internal combustion engine utilizing the fuel injector of the present invention;

FIG. 2 is a side cross sectional view of the fuel injector;

FIG. 7 is an enlarged side cross sectional view of the fuel injector with both the air and fuel outlet ports shown in their open position.

DESCRIPTION OF THE PREFERRED EMBODIMENT

Figure 3:
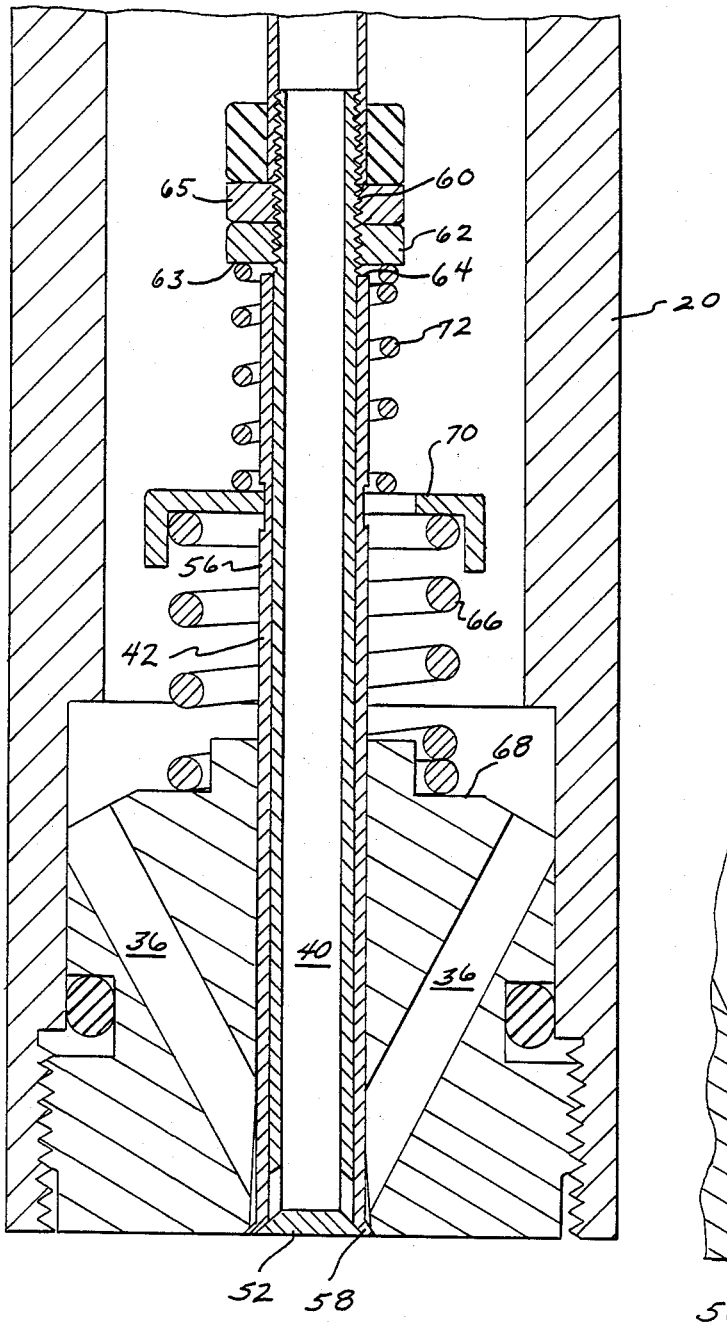
FIG. 3 is a side cross sectional view of the lower portion of the fuel injector.

As shown in FIG. 1, a fuel injector 10 is provided with a body 12 having an upper portion 14 that has an air inlet port 16 and a fuel inlet port 18. Body 12 is also provided with a lower portion 20 that is inserted into an opening in engine cylinder 22 and is provided with an air outlet port 24 and a fuel outlet port 26 that communicate directly with combustion chamber 28. The upper portion of engine cylinder 22 is also provided with an opening that accommodates spark plug 30. The illustrated engine is a two-cycle engine having air inlet ports in the cylinder wall to supply air as the air inlet ports and are uncovered by the piston, not illustrated. In the particular embodiment, the exhaust is also through piston controlled ports in the cylinder wall.

As shown in FIG. 2, fuel inlet port 18 communicates with horizontal passageway 32 which in turn communicates with vertical passageway 34 that extends downwardly through fuel injector body 12 and eventually communicates with angular passageway 36 that terminates in fuel outlet port 26.

Air inlet port 16 communicates directly with internal vertical passageway 40 which is comprised of the interior of tubular member 42. Tubular member 42 consists of an upper portion 44 and a lower portion 46 which are connected by means of a bellows arrangement 48.

Bellows 48 allows for vertical sliding movement of lower portion 46 while upper portion 44 is allowed to remain stationery.

Disposed within injector body 12 and surrounding tubular member 42 is solenoid 50. Energization of solenoid 50 results in a downward force on tubular member 42 causing tubular member 42 to slide downwardly within fuel injector body 12.

Figure 5:
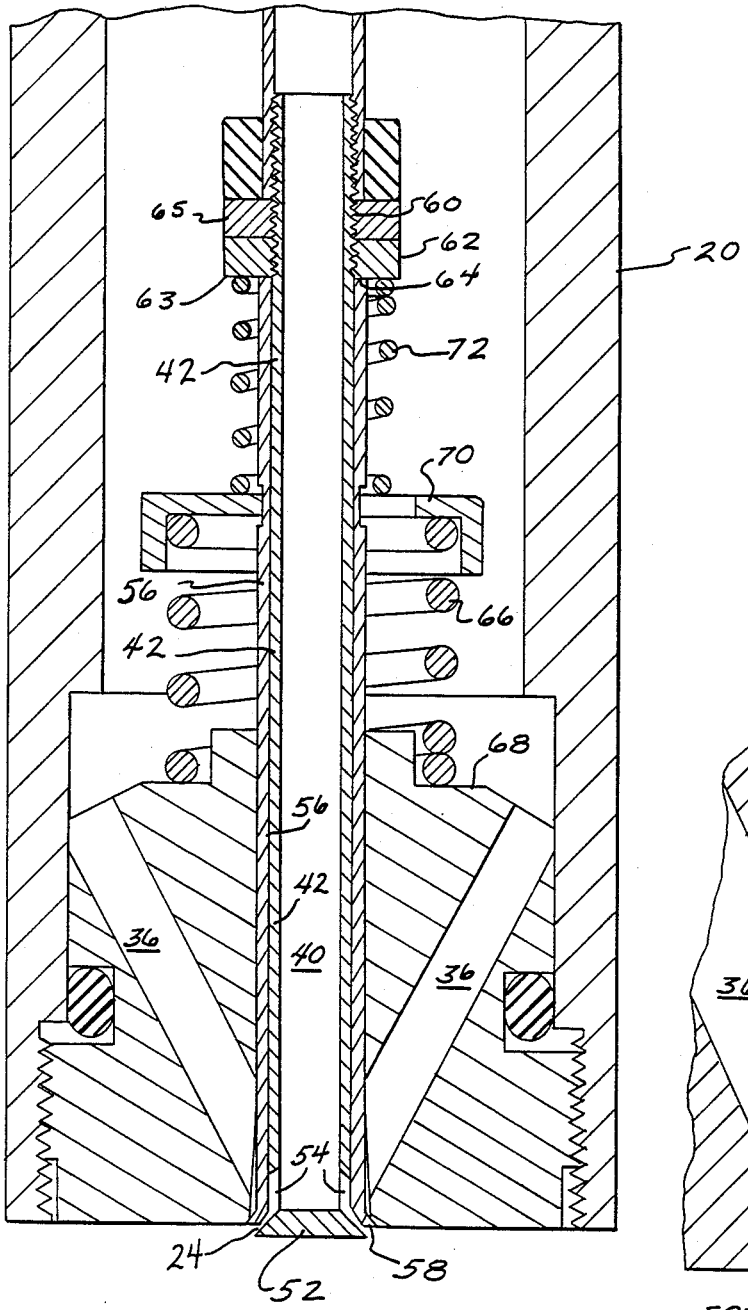
FIG. 5 is a side cross sectional view of the lower portion of the fuel injector with the valve for the air outlet port shown in the open position.
Figure 6:
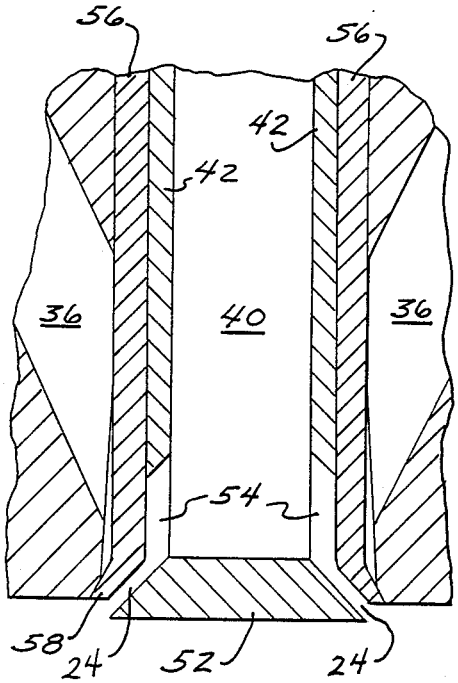
FIG. 6 is an enlarged side cross sectional view of the fuel injector of FIG. 5 with the valve for the air outlet shown in its open position.

As best seen in FIGS. 5 and 6, tubular member 42 terminates in a frusto conical end piece 52 which serves to seal air outlet port 24 when tubular member 42 is in its retracted position. When tubular member 42 is in its extended position as shown in FIGS. 5 and 6, end piece 52 extends outwardly from injector body 12 and air from vertical passageway 40 is allowed to pass through sidewall openings 54 in tubular member 42 and out through air outlet port 24 and into combustion chamber 28.

A second tubular member 56 is slidably disposed around first tubular member 42 and has its lower end terminating in an outwardly and downwardly extending lip 58.

When tubular member 56 is in its retracted position as shown in FIGS. 5 and 6, lip 58 is seated against injector body 12 and closes fuel outlet port 26. When second tubular member 56 is in its extended position, lip 58 extends downwardly beyond injector body 12 so as to open fuel outlet port 26 and allow fuel to flow from angular passageway 36 and out through fuel port 26 and into combustion chamber 28. The frusto conical shape of end piece 52 causes the airflow from air outlet port 24 to be directed at an angle to the fuel flow from fuel port 26 thus resulting in the atomization of the fuel in combustion chamber 28.

The outer surface of the upper portion of tubular member 42 is provided with thread 60 onto which a nut 62 is rotatably disposed. Nut 62 provides a shoulder 63 that extends radially from the upper portion of tubular member 42. Extension of tubular member 42 by solenoid 50 eventually causes nut 62 to come into engagement with upper edge 64 of second tubular member 56. The position of nut 62 thus limits the extent of opening of air port 24. Upon engagement, any further extension of first tubular member 42 results in a corresponding extension of second tubular member 56. The length of extension through which first tubular member 42 can travel before engaging second tubular member 56 and causing its movement can be varied by rotating nut 62 on thread 60. A locking nut 65 is provided to secure nut 62 in the desired position.

The extent of opening of fuel port 26 is adjustably controlled by the position of spring seat 68 relative to lower portion 20. The position of the spring seat 68 can be adjusted by means of the threaded engagement with lower portion 20. Turing spring seat 68 further into lower portion 20, as shown in FIG. 2, will increase the gap 71 between the abutment 43 formed on tubular member 42 and lower portion 20. Increasing the gap 71 allows increased movement of tubular member 42 and thus increased opening of fuel port 26.

The interior of injector body 12 is provided with a main spring 66 which is contained between spring seat 68 and spring retainer 70 that is connected to and extends outwardly from second tubular member 56. Main spring 66 provides a biasing force on second tubular member 56 that urges tubular member 56 to its retracted position.

Similarly, a secondary spring 72 is disposed between spring retainer 70 and the bottom surface of nut 62. Secondary spring 72 provides a biasing force that urges first tubular member 42 to its retracted position.

Figure 4:
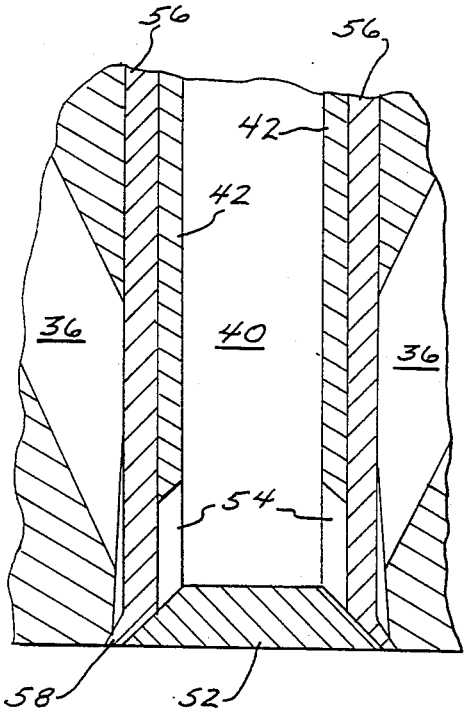
FIG. 4 is an enlarged side cross sectional view of the fuel injector of FIG. 3 with the air and fuel outlet ports shown closed by their associated valves.

In operation and as shown in FIGS. 3 and 4, both tubular members 42 and 56 are in their retracted positions and lip 58 has sealed fuel outlet port 26 and end portion 52 has sealed air outlet port 24. In these retracted positions, there is a space between nut 62 and upper edge 64 of second tubular member 56.

In FIGS. 5 and 6, solenoid 50 has been energized and first tubular member 42 is partially extended to the point where the space between nut 62 and upper edge 64 of second tubular member 56 has been closed. In this position, end portion 52 has extended outwardly from lip 58 where it was seated so as to open air outlet port 24 and allow the flow of air from vertical passageway 40, through outlet port 24 and into combustion chamber 28. Second tubular member 56 has yet to be extended since nut 62 has just come into contact with upper edge 64 and therefore fuel outlet port 26 remains closed by lip 58. Thus air port 24 will open prior to fuel port 26.

In FIG. 7, first tubular member 42 has been further extended and this further extension has resulted in the extension of second tubular member 56 due to the downward force of nut 62 on upper edge 64 of second tubular member 56. In this position, lip 58 has extended beyond injector body 12 and fuel is allowed to pass from angular passageway 36 through fuel outlet port 26 and into combustion chamber 28. As the fuel flows into combustion chamber 28 it is atomized by the flow of air from outlet port 24. Preferably with both ports 24 and 26 open, the air outlet port 24 will define a conical airflow having a cone angle of approximately 90°, while the fuel port 26 will define a conical fuel flow pattern of approximately 60°. The intersection of the fuel and air flows will thus provide the desired atomization.

When solenoid 50 is de-energized, the biasing force of springs 66 and 72 will urge first tubular member 42 and second tubular member 56 into their retracted positions. It can be seen that lip 58 will return to its seated position against injector body 12 prior to end portion 52 returning to its seated position against lip 58. Thus, the flow of fuel through fuel outlet port 26 will be terminated slightly before the flow of air through air outlet port 24. This initiation of the airflow prior to the introduction of fuel and the continuation of the airflow after the discontinuance of the fuel flow is desirable in that it insures that the fuel will be broken up into smaller particles from the beginning to the end of the fueling cycle.

It is recognized that various alternatives and modifications are possible in the scope of the appended claims.

I claim:

1. A fuel injector for introducing a mixture of air and fuel into the combustion chamber of an internal combustion engine, said injector comprising:

a body having an air inlet port and a fuel inlet port with said body having a first passageway communicating said fuel inlet port with a fuel outlet port for delivering fuel to the combustion chamber and a second passageway communicating said air inlet port with an air outlet port for delivering air to the combustion chamber, said air outlet port being disposed radially inwardly and substantially adjacent said fuel outlet port and disposed so as to direct the emerging air stream outwardly against said emerging fuel stream in order to create an air/fuel mixture in the combustion chamber, first valve means movable between a first position in which said air outlet port is closed and a second position in which said air outlet port is open, second valve means movable between a first position in which said fuel outlet port is closed and a second position in which said fuel outlet port is open, actuating means to move said first and second valve means between their first and second positions said actuating means moving said first valve means to its second position prior to moving said second valve means to its second position and returning said second valve means to its first position prior to returning said first valve means to its first position.

2. The fuel injector defined in claim 1 further comprising biasing means urging said first and second valve means to their first positions.

3. The fuel injector defined in claim 1 further comprising adjustment means for varying the time period between the movement of said first valve means between its first and second positions and the subsequent movement of said second valve means between its first and second positions.

4. The fuel injector defined in claim 1 wherein said first valve means comprises a first tubular member slidably disposed within said body, said first tubular member terminating in a closed end and having a plurality of side wall openings adjacent said closed end, the interior of said first tubular member defining said second passageway with said sidewall openings communicating with said air outlet port, and, said first closed position of said first valve means being a retracted position of said first tubular member in which said closed end seals said air outlet port and said second open position of said first valve means being an extended position of said first tubular member in which said closed end extends outwardly from said body in order to open said air outlet port and permit air from the interior of said first tubular member to flow through said sidewall openings, out said outlet port and into the combustion chamber.

5. The fuel injector defined in claim 1 in which said second valve means comprises a second tubular member slidably disposed within said body and terminating in an outwardly and downwardly extending lip, said first closed position of said second valve means being a retracted position of said second tubular member in which said lip seals said fuel outlet port and said second open position of said second valve means being an extended position of said second tubular member in which said lip extends outwardly from said body to open said fuel outlet port and permit fuel to flow into the combustion chamber.

6. The fuel injector defined in claim 4 in which said second valve means comprises a second tubular member slidably disposed within said body and terminating in an outwardly and downwardly extending lip, said first closed position of said second valve means being a retracted position of said second tubular member in which said lip seals said fuel outlet port and said second open position of said second valve means being an extended position of said second tubular member in which said lip extends outwardly from said body to open said fuel outlet port and permit fuel to flow into the combustion chamber.

7. The fuel injector defined in claim 6 in which said first tubular member is slidably disposed within said second tubular member and extends upwardly from said second tubular member into said body and said closed end of said first tubular member is tapered so as to direct the airflow downwardly and outwardly into the combustion chamber and intersecting the fuel flow.

8. The fuel injector of claim 4 in which said actuating means comprises means for extending said first tubular member and a shoulder extending radially from the upper portion of said first tubular member that extends beyond said second tubular member, said shoulder spaced from the inner end of said second tubular member whereby extension of said first tubular member by said extension means results in a subsequent engagement of said shoulder with the end of said second tubular member so that continued extension of said first tubular member results in extension of said second tubular member.

9. The fuel injector of claim 8 in which said shoulder comprises a nut rotatably disposed on threads on the outer wall of said first tubular member whereby rotation of said nut varies the distance between the nut and the inner end of said second tubular member.

10. The fuel injector defined in claim 8 in which said extension means comprises a solenoid in operable engagement with an upwardly extending portion of said first tubular member.

11. A fuel injector for introducing a mixture of air and fuel into the combustion chamber of an internal combustion engine, said injector comprising:

a body having an air inlet port and a fuel inlet port with said body having a first passageway communicating said fuel inlet port with a fuel outlet port for delivering fuel to the combustion chamber and a second passageway communicating said air inlet port with an air outlet port for delivering air to the combustion chamber, said air outlet port being disposed substantially adjacent said fuel outlet port and disposed so as to direct the emerging fuel stream into said emerging air stream in order to create an air/fuel mixture in the combustion chamber, first valve means movable between a first position in which said air outlet port is closed and a second position in which said air outlet port is open, said first valve means comprising a first tubular member slidably disposed within said body, said first tubular member terminating in a closed end and having a plurality of side wall openings adjacent said closed end, the interior of said first tubular member defining said second passageway with said sidewall openings communicating with said air outlet port, and, said first closed position of said first valve means being a retracted position of said first tubular member in which said closed end seals said air outlet port and said second open position of said first valve means being an extended position of said first tubular member in which said closed end extends outwardly from said body in order to open said air outlet port and permit air from the interior of said first tubular member to flow through said sidewall openings, out said outlet port and into the combustion chamber, second valve means movable between a first position in which said fuel outlet port is closed and a second position in which said fuel outlet port is open, said second valve means comprising a second tubular member slidably disposed within said body and terminating in an outwardly and downwardly extending lip, said first closed position of said second valve means being a retracted position of said second tubular member in which said lip seals said fuel outlet port and said second open position of said second valve means being an extended position of said second tubular member in which said lip extends outwardly from said body to open said fuel outlet port and permit fuel to flow into the combustion chamber, and actuating means to move said first and second valve means between their first and second positions said actuating means comprising means for extending said first tubular member and a shoulder extending radially from the portion of said first tubular member that extends beyond said second tubular member, said shoulder spaced from the inner end of said second tubular member whereby extension of said first tubular member by said extension means results in a subsequent engagement of said shoulder with the end of said second tubular member so that continued extension of said first tubular member results in extension of said second tubular member.

* * * * *